United States Patent [19]

Sloan

[11] Patent Number: 4,793,386

[45] Date of Patent: Dec. 27, 1988

[54] APPARATUS AND METHOD USING PORTABLE PUMP

[75] Inventor: Albert H. Sloan, Ft. Lauderdale, Fla.

[73] Assignee: Sloan Pump Company, Inc., Ft. Lauderdale, Fla.

[21] Appl. No.: 92,561

[22] Filed: Sep. 3, 1987

[51] Int. Cl.[4] ..... B08B 9/08

[52] U.S. Cl. ..... 141/65; 141/231; 137/351; 137/355.19

[58] Field of Search ..... 141/65, 114, 231, 26, 141/382, 386, 387–389; 137/561 R, 565, 355.16, 355.17, 355.19; 134/168 R, 169 R, 284; 417/231, 234, 323, 371, 379, 380, 502, 512

[56] References Cited

U.S. PATENT DOCUMENTS

| | | | |
|---|---|---|---|
| 2,519,064 | 8/1950 | Palm | 137/355.19 |
| 2,596,151 | 5/1952 | Hudson | 134/168 R |
| 2,638,224 | 5/1953 | Rupp | 141/26 X |
| 3,621,893 | 11/1971 | Nishimura et al. | 141/65 |
| 3,848,685 | 11/1974 | Takagi et al. | 137/355,19 X |
| 4,097,925 | 6/1978 | Butler | 417/231 X |
| 4,213,479 | 7/1980 | Pearson | 137/351 X |
| 4,525,277 | 6/1985 | Poulin | 137/351 X |
| 4,693,271 | 9/1987 | Hargrove et al. | 137/565 |

*Primary Examiner*—Donald Watkins

*Attorney, Agent, or Firm*—James E. Nilles; Thomas F. Kirby

[57] ABSTRACT

Apparatus and methods use a portable submersible pump to mix and fluidize waste material (sludge, liquid and floating crust) in a septic tank, to then pump it into a truck-mounted holding tank to recirculate it in the holding tank during transport, and to discharge it at a disposal site. The apparatus comprises a truck-mounted holding tank having tank inlet and outlet ports, a portable hydraulically driven submersible pump detachably mounted on the truck, and a truck-mounted motor-driven hydraulic pump for operating the portable pump. Hydraulic fluid supply lines, wound on a truck-mounted reel, are connected between the hydraulic pump and the portable pump motor. A waste hose is wound on a truck-mounted reel, several hose sections are detachably mounted on the truck, and a portable, multi-position, manually-operable selector valve is detachably mounted on the truck. In operation, the portable pump is disposed alongside or in the septic tank and pumps a stream of pressurized fluid from the septic tank. Various combinations enable the stream to be pumped directly into the truck-mounted holding tank, or to be mixed and recirculated in the septic tank prior to being pumped into the holding tank. After the components are stowed, they can be used to recirculate the mixture in the truck-mounted holding tank during transport and/or to empty the latter.

63 Claims, 6 Drawing Sheets

APPARATUS AND METHOD USING PORTABLE PUMP

BACKGROUND OF THE INVENTION

1. Field of Use

This invention relates to apparatus and methods using a portable pump to mix, remove and dispose of fluid material, such as sewage, accumulated in a tank, such as a septic tank, storage pond or the like.

2. Description of the Prior Art

In some industrial processes or in various kinds of systems, such as sewerage systems, it is necessary to accumulate fluid or liquid material in one tank or container and to periodically pump it into another tank for further processing or disposal. The type of process, the nature and composition of the fluid or liquid material, and the location and purpose of the tanks dictate the apparatus and methods to be employed. In some cases the fluid or liquid material takes the form of a mixture of liquids of different specific gravities or a mixture of liquid and solid particulate matter. However, the liquids may separate or the solid particulate matter may settle out and it is sometimes necessary to remix the material before pumping it from one tank to the other. In the case of sewage comprising a mixture of liquid and solid particulate matter, including organic waste material, dirt and sand, special problems can arise.

For example, large municipal sewerage systems typically employ an "aerobic" digestive treatment process wherein liquid waste material and solid waste material is constantly stirred and mixed in a tank by mechanical means while the biochemical treatment is occurring, and, therefore, such an emulsified, fluidized effluent can easily and efficiently be pumped from one tank to another.

However, smaller sewerage systems typically employ a septic tank or holding pond to receive and accumulate sewage supplied from residential and commercial buildings. These septic systems employ an "aerobic" digestive treatment process wherein the sewage in the septic tank or holding pond is not stirred while the biochemical treatment is occurring. The sewage typically comprises a fluid mixture of liquid waste material, solid organic waste material, and solid inorganic waste material, such as sand or dirt. The unstirred sewage in the septic tank or pond gradually undergoes chemical, biochemical and physical changes with the following results: a relatively heavy sludge of mud-like consistency, including solid particulate waste material and sand, settles out at the bottom of the septic tank or holding pond; clarified and relatively clean water accumulates in a digestive zone above the sludge; and relatively light solid waste material floats to the surface of the water and gradually dries to form a crust of earth-like consistency. Most of the clarified liquid is eventually drained off by gravity to a drainage field connected to the septic tank or holding pond. However, over a period of time sludge and crust build up in the septic tank or holding pond must be periodically removed and disposed of so as to restore the tank or pond to its full processing capacity. In a storage pond, the layers of sludge and crust can each reach several feet in thickness. In a septic tank, each layer may be on the order of 1½" to 18" in thickness.

Two types of septic tanks are in general use. One is a concrete box (on the order of 5 feet deep, 4 feet wide and 7 feet long) buried in the earth and having its open top side (flush with ground level) closed by a lid or cover in the form of removable concrete slabs. The other is a cylindrical tank (typically fiberglass or plastic) disposed horizontally underground and having relatively small access openings (about 1½" in diameter) at opposite ends (flush with ground level) which are closed by removable hatch covers or plates.

Periodic cleaning of such septic tanks involves break-up of the crust; removal of the broken crust, sludge and water remaining in the septic tank; and transport thereof to and unloading at a suitable disposal site. Prior art apparatus for this purpose typically comprises a vehicle, such as a truck or trailer driven or towed to the jobsite, having the following equipment mounted thereon, namely: a sewage holding tank, a pump permanently mounted on the vehicle, a prime mover for driving the pump (such as a PTO on a truck engine or a separate internal combustion engine mounted on a trailer); necessary hose-sections and valving, all connectable for operation by the equipment operator at the jobsite; and suitable hoe-like or paddle-like tools to manually break up the crust and to mix the waste materials in the septic tank to provide a fluidized mixture which the pump can handle.

Prior art techniques employed by the operator to effect manual crust break-up and mixing by means of tools involve difficult, time-consuming, costly and dirty manual labor. Often, fresh water is introduced into the septic tank through a garden hose to dilute the mixture and facilitate pumping. Of course, addition of fresh water increases the volume of sewage to be pumped from the septic tank, requires a vehicle-mounted holding tank of larger capacity than would otherwise be needed, and increases the disposal fees at the disposal site, which are charged for on a volume basis. In addition, since the size and location of the hatch openings in a cylindrical-type septic tank limit access to the tank interior, prior art techniques involving insertion and manipulation of hand tools are not well-suited to permit thorough crust break-up and mixing, and some operators limit themselves to removing only liquids remaining in the septic tank and ignore the unbroken crust and sludge.

Furthermore, the types of pumps and hose arrangements used in prior art septic tank cleaning systems and apparatus are not efficient. Typically, such pumps are permanently mounted on the vehicle and the intake side of a pump is connected to the septic tank by large-diameter (3" or more) hose sections carried on the vehicle and manually assembled and connected at the jobsite. Unless such hose sections are thoroughly flushed out by clean water after use and prior to restorage on the vehicle, sewage remaining in the hose sections dries out and cakes therein, thereby reducing effective hose diameter for subsequent use and serving as a source of foul and offensive odors.

As to the pumps used in prior art systems, the oldest, least-productive and now least-used type is a diaphragm pump which "sucks" the effluent from the septic tank. This pump, which employs a mechanically driven flexible diaphragm to draw a vacuum on one side, employs two ball-type check valves, one each at the inlet and outlet ends of the pump, has several drawbacks. For example, an appropriately-sized pump of this type is inefficient and exerts only a limited net positive suction head (typically 10.8 psi). In addition, pump volume drops off from 5280 gallons per hour at a 5-foot head to 3500 gallons per hour at a 25-foot head, for example. Furthermore, pump stroke or action is pulsating, intermittent and jerky and debris and sludge tend to hang up in the check valves which then need to be disassembled and cleaned while the system is shut down.

Another prior art system is similar to that above-described but uses a truck-mounted self-priming trash pump, such as a "midwhirled" or "impressed vortex" type trash pump, instead of a diaphragm pump. However, although this type of pump requires only one check valve for priming and this valve is not easily clogged, this type of pump is only slightly more efficient than the diaphragm pump (dropping as low as 20% to 10% efficiency when it becomes unprimed) and imposes a time-delay while it is being reprimed.

Still another prior art system, which is presently most widely used, employs a vehicle-mounted vacuum pump which is connected to a holding tank mounted on the vehicle. The tank must be of heavy-duty construction because it is subjected to high internal vacuum (20 to 25 inches of mercury) when the vacuum pump operates to "suck" effluent thereinto from the septic tank and is subsequently subjected to high internal pressure (i.e., up to 14 psi) when the vacuum pump is operated in reverse to expel effluent from the holding tank for ultimate disposal. The vacuum pump is provided with inlet and outlet valves aimed at preventing effluent from entering thereinto. The drawbacks of this system are that the valves are trouble-prone and can be clogged, the vehicle-mounted holding tank must be relatively strong and heavy to withstand both high vacuum and high pressure, and large diameter (about 3" diameter, for example), multi-section connectable/disconnectable camlock type hoses must be stored on the vehicle, assembled and disassembled, and internally cleaned.

Using a pump which is permanently mounted on the vehicle to empty a septic tank which is typically located at a relatively long distance from the pump substantially reduces pump and system efficiency. Insofar as applicant is presently aware, no prior art system uses a portable pump, powered from a power supply source on the vehicle, which can be removed from the vehicle and disposed near or in the septic tank to effect pumping of effluent therefrom into a holding tank on the vehicle or to effect mixing and subsequent pumping. Furthermore, applicant is unaware of the use of such a portable pump, when stored on the vehicle, to recirculate effluent in the vehicle-mounted holding tank and to discharge it therefrom.

U.S. Pat. Nos. 3,910,728, 4,352,251 and 4,529,359, all owned by the same assignee as the present application, disclose portable submersible pumps and means for driving such pumps. However, none of these patents disclose the use of a portable pump, such as a submersible pump, to remove effluent from a septic tank or holding pond and deliver it to a holding tank. Furthermore, none of these patents disclose use of a portable pump, such as a submersible pump, to mix liquid in one vessel, such as a septic tank, and to subsequently transfer the mixed liquid to another vessel, such as a vehicle-mounted holding tank. None of these patents discloses use of a portable pump on a transport vehicle which is usable to clean a septic tank and is further usable to mix and discharge effluent carried in a holding tank thereon.

SUMMARY OF THE INVENTION

The present invention provides improved apparatus and methods using a portable pump. The invention is particularly well-suited to pump fluidized sewage from a septic tank into a vehicle-mounted holding tank for subsequent transport and disposal. However, the invention is not so limited and could have other uses.

In a preferred embodiment of the invention disclosed herein, the apparatus generally comprises a vehicle (such as a truck, trailer, or combination of both) which can be moved to a jobsite whereat a first tank, such as a septic tank or holding pond is located, and to a disposal site whereat effluent removed from the septic tank or holding pond can be disposed of.

Mounted on the vehicle are: a holding tank having a tank inlet port and a tank outlet port; a portable pump,-preferably a light-weight submersible pump which can run wet or dry, stowable on the vehicle and having a pump inlet port and a pump outlet port and a pump motor; power supply means carried on the vehicle and connected to operate the portable pump motor; and hose means connectable in various ways.

Preferably, the pump motor is a hydraulic motor and the power supply means therefor comprises a hydraulic pump mounted on the vehicle and driven by an internal combustion engine on the vehicle. The power supply means further include a pair of hydraulic fluid hoses which are connected between the hydraulic pump and the hydraulic motor of the portable pump. The hydraulic fluid hoses are wound on a hose reel mounted on the vehicle. However, the portable pump motor could be an electric motor or a pneumatic motor driven by suitable power supply means on the vehicle (generator or air compressor) and connected thereto by reel-mounted electric wires or a reel-mounted air hose, respectively.

The portable pump can be moved to positions remote from the vehicle and near to the septic tank, i.e., wherein it is either adjacent to or disposed within the septic tank. The portable pump can then be connected and operated in several ways: first, to pump fluid from the septic tank to the holding tank or, second, to recirculate fluid in the septic tank to effect mixing and then to pump the mixed fluid from the septic tank to the holding tank.

After the portable pump is stowed on the vehicle, it can be connected and operated in several ways: first, when the vehicle reaches a disposal site, to pump fluid from the holding tank into a disposal site or, second, to recirculate fluid in the holding tank to effect mixing, as during road transport, and then, when the vehicle reaches the disposal site, to pump the mixed fluid from the holding tank into the disposal site.

Preferably, the hose means comprise a long (200-foot) waste hose wound on a hose reel on the vehicle and a plurality of separate relatively short (on the order of 20 feet) hose sections which are stowable on the vehicle.

As previously mentioned, the portable pump can be located, connected by the hose means and operated in a variety of ways at the jobsite, during road transport and at the disposal site to achieve desired results. The above-described apparatus further includes a portable multiposition manually operable selector valve which is detachably mounted on the vehicle and is usable, either while detached from the vehicle or while mounted thereon, to connect the hose means in various ways, thereby avoiding the need to connect and disconnect certain hose sections.

The portable pump is operable, when submerged in liquid in the septic tank (or when provided with a hose section which extends into the septic tank) and to direct a stream of liquid from the septic tank, through tee pump, and through various hose sections, (and the selector valve, if used) and through the opening in the septic tank to effect crust break-up, mixing, fluidization and recirculation of fluid in the septic tank. The portable pump is further operable (with or without) the selector valve to direct the stream through the reel-mounted waste hose and into the holding tank on the vehicle.

The portable pump and selector valve, when both are mounted on the vehicle, can be used both to recirculate the effluent in the vehicle holding tank during transport and to subsequently discharge the effluent from the holding tank for ultimate disposal at the disposal site, provided the pump inlet port is connected to the holding tank outlet port by a suitable hose section or conduit.

The method in accordance with the invention in its broadest aspect comprises the steps of: providing a holding tank, disposing a portable pump having a pump inlet port and a pump outlet port remotely from the holding tank and adjacent another tank, such as a septic tank, supplying liquid (or a fluid mixture of liquids and solids) from the septic tank to the portable pump either by means of a hose section or submersion of the pump, and operating the pump to pump liquid from the septic tank into the holding tank.

Another aspect of the method comprises the steps of providing a portable pump having a pump inlet port and a pump outlet port, supplying liquid (or a fluid mixture) from a tank, such as a septic tank, to the inlet port of the pump, operating the pump to pump liquid from the septic tank and to provide a stream of liquid (or fluid mixture) at high pressure, and directing the stream back into the tank to effect mixing of the contents therein.

A further aspect of the method comprises the steps of: employing a portable pump to pump a stream of liquid (or fluid mixture) from a first (septic) tank, redirecting the stream under high pressure back into the first tank to effect mixing of the contents therein, recirculating the mixture, and subsequently pumping the mixture from the first tank into a holding tank for ultimate disposal therefrom.

The method also contemplates the further step of using the portable pump to recirculate the mixture in the holding tank prior to discharging it therefrom for ultimate disposal.

The apparatus and method in accordance with the present invention offers several advantages over the prior art, especially when applied to cleaning septic tanks. For example, the apparatus employs a vehicle-mounted holding tank and a portable pump stowable on the vehicle which can be deployed at the job-site remote from the holding tank and near the septic tank (adjacent or within) and driven by a power source mounted on the vehicle. Pump and system efficiency are substantially improved by being able to locate the portable pump near the tank to be pumped out. The pump is portable, light-weight, easily carried, capable of handling liquid alone or a mixture of liquid and solids of relatively large size (up to 1½" in the example shown), operable wet (i.e., submerged) or dry, and is highly efficient. Furthermore, the pump employs no valves which are subject to clogging. On the other hand, in the prior art, the pump is permanently mounted on the vehicle and must be connected to the septic tank by a long, large diameter hose which introduces system inefficiencies. Furthermore, prior art pumps take the form of a relatively inefficient, trouble-prone diaphragm pump or vacuum pump employing check valves which require service. The portable pump disclosed exerts a positive high pressure force to effect rapid and efficient pumping from the septic tank to the holding tank and is further operable, if desired, to effect mixing and recirculation of liquid and solids in the first tank before effecting subsequent flow to the holding tank. The portable pump can be connected to provide a high pressure stream of recirculated effluent from the septic tank to break up any crust that has formed therein and to mix it, along with heavy sludge at the bottom of the septic tank, with liquid from the septic tank. This substantially reduces or eliminates the costly and time-consuming manual labor formerly needed to accomplish crust break-up and mixing. In addition, use of such a high pressure stream of recirculated effluent enables more efficient fluidization of sewage contained in cylindrical-type septic tanks wherein the access for tools to effect manual crust break-up and mixing is severely limited by the shape of the tank and the size and location of the access opening for such tanks. The use of recirculated high pressure liquid from the tank to be pumped, instead of additional fresh water supplied from a hose, to effect crust break-up, mixing and fluidization, results in a size and weight reduction of the vehicle holding tank, since it need not be designed to hold additional waste. Also, disposal fees are reduced. Furthermore, since the holding tank can be smaller, a smaller, more economical vehicle can be employed. One portable pump can perform several functions, namely: recirculation of liquid in the first tank, pumping of liquid from the first tank into the second tank for temporary storage, mixing the liquid while in the second tank, and pumping of liquid from the second tank for ultimate disposal. The necessary hoses are conveniently stored on the vehicle, either while still connected or when disassembled, and certain of them are conveniently mounted on power-driven hose reels thereon. The open end of any hose section which handles effluent can be closed by a detachable cap, thereby eliminating the need to flush the hose section and preventing obnoxious odors. The apparatus is smaller, more economical to construct and operate, and more powerful, more reliable, more versatile, and more efficient to use.

Other objects and advantages will hereinafter appear.

DRAWINGS

FIG. 7 depicts an alternative arrangement for driving it by its own engine so it can be used on a trailer;

DESCRIPTION OF PREFERRED EMBODIMENTS

General Arrangement

Figure 1:
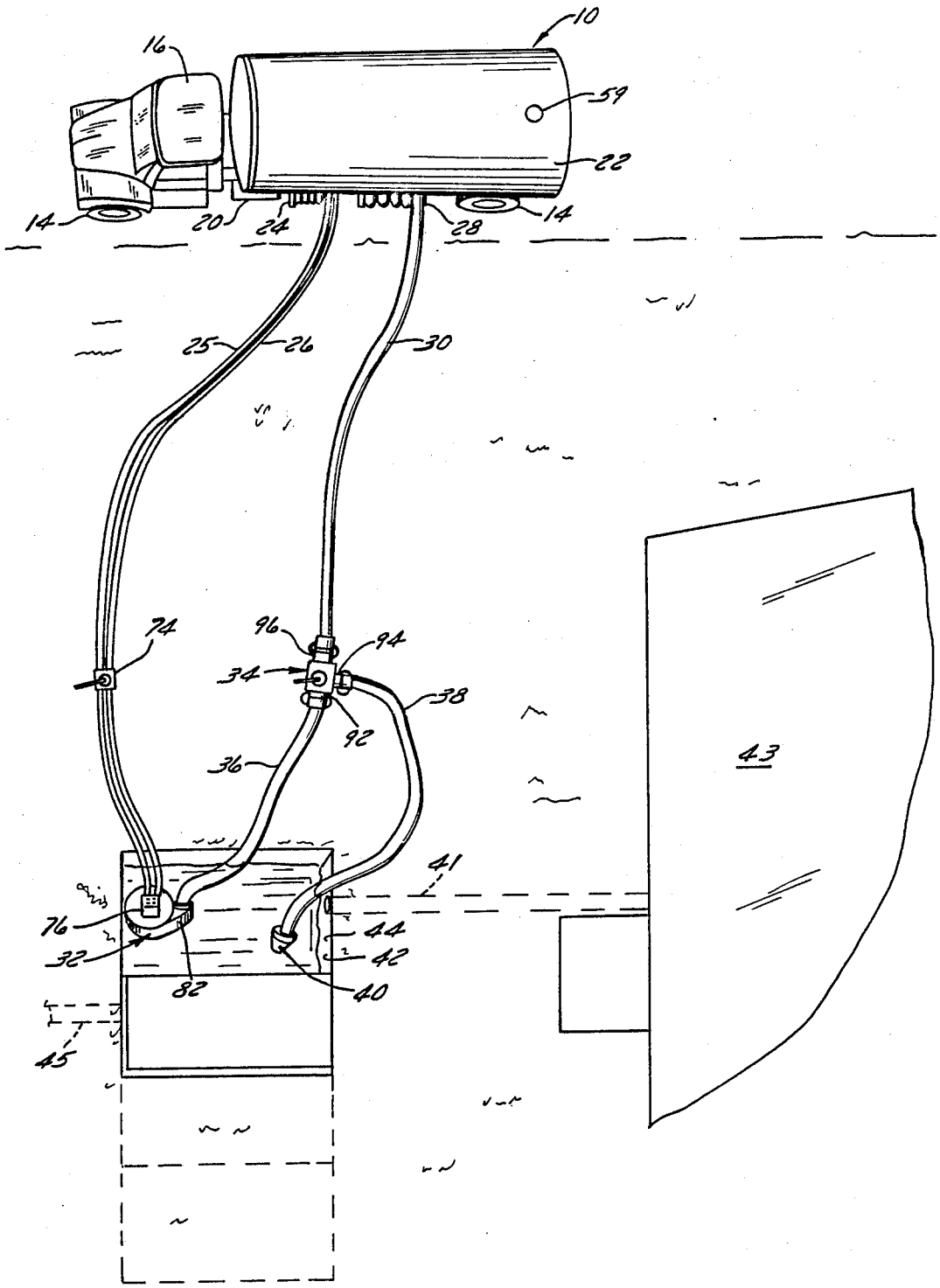
FIG. 1 is a perspective view, taken from above, of a vehicle having apparatus in accordance with the present invention and shown in association with a septic tank which is to be pumped out.
Figure 2:
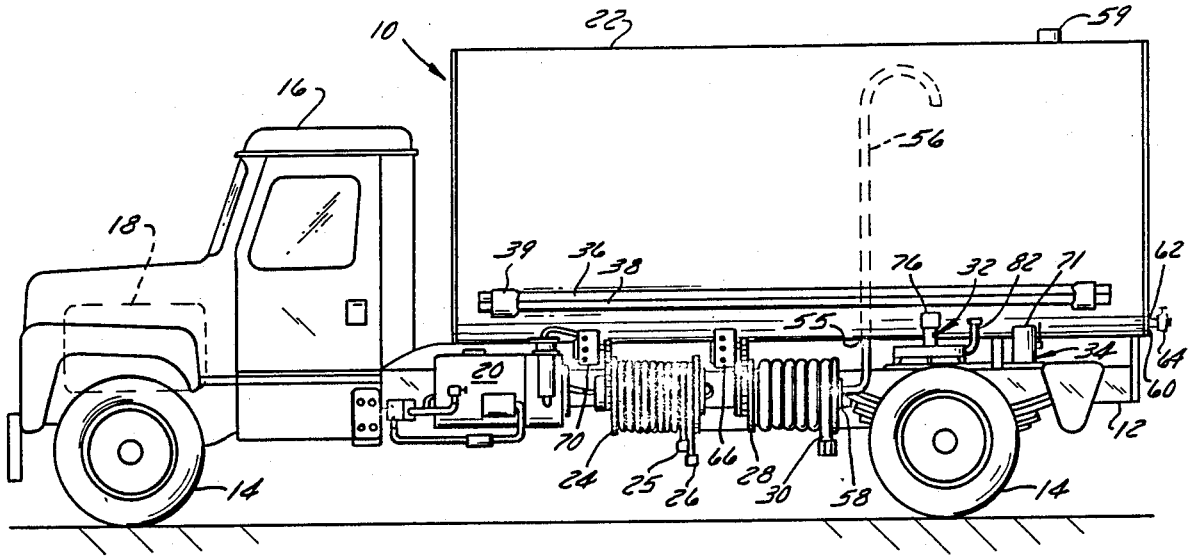
FIG. 2 is an enlarged side elevation view of the vehicle in shown in FIG. 1.

FIGS. 1 and 2 show a vehicle on which system components for apparatus in accordance with the invention are mounted and carried, as to a jobsite where a septic tank 42 is located, and then to a disposal site. The vehicle is shown as a truck 10 but could be a towable trailer or a combination of a truck and trailer with some components mounted on each. Truck 10 comprises a chassis 12 having wheels 14, a driver's cab 16 and an internal combustion engine 18 which supplies motive power for the truck and also supplies operating power for various system components, as hereinafter explained.

FIG. 2 shows the system components as they are arranged when disassembled and disconnected and stored on truck 10 for transport. FIG. 1 shows them assembled, connected and deployed as when servicing septic tank 42 in accordance with FIGS. 15 and 16. As will be understood, the components when assembled and connected as shown in FIG. 1 can be mounted on truck 10 for transport to and from a jobsite or disposal site.

The system components include: a sewage holding tank 22; a detachable portable submersible pump 32 having a submersible hydraulically-driven pump motor 76 thereon; means to drive pump motor 76 and including a hydraulic pump 20 driven by truck engine 18 and flexible hydraulic fluid lines on hoses 25 and 26; hose means including a sewage hose 30 and a plurality of hose sections 36, 38, 36A and 65; and an optionally usable detachable portable manually operable multi-position selector valve 34.

The several system components will now be described in detail.

Holding Tank

As FIGS. 1, 2 and 11 through 14 show, holding tank 22 is a large horizontally disposed cylindrical steel tank rigidly mounted on chassis 12 and has tank inlet port 55 through which sewage is pumped into tank 22 and tank outlet port 60 from which sewage is pumped out of holding tank 22. Both ports 55 and 60 are located near the bottom of holding tank 22. To prevent back-flow, tank inlet port 55 is connected to the lower end of a passage in a rigid conduit or pipe 56 which extends upwardly into tank 22 through the bottom side thereof and then curves downwardly so as to admit sewage near the top of the tank interior and direct it downwardly. Pipe 56 has a coupling 58 on its outer lower end by means of which it is connected to the fixed end of reel-mounted sewage hose 30. Tank outlet port 60 is defined by a short conduit or pipe 62 located near the bottom rear end of tank 22 and has a manually operable shut-off valve 64 therein. Tank 22 has an air vent 59 on its upper side.

Hydraulic Pump

Portable pump 36, which is hereinafter described in more detail, comprises a hollow housing 100 on which pump motor 76 is mounted and which has a pump inlet port 80 and a pump outlet or discharge port 82. Pump motor 76 is supplied with hydraulic fluid from hydraulic pump 20 by means of the pair of fluid lines or hoses 25 and 26 through a manually operable control valve 74. Portable pump 36 is detachably mounted on truck 10 as by a holder 71 on chassis 12.

Figure 7:
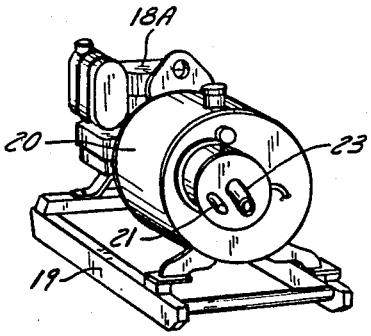
FIG. 7 is a perspective view, taken from the hydraulic fluid supply end, of a hydraulic pump which supplies hydraulic operating fluid for driving the submersible pump drive motor shown in FIGS. 1, 2, 4, 5 and 6.
Figure 8:
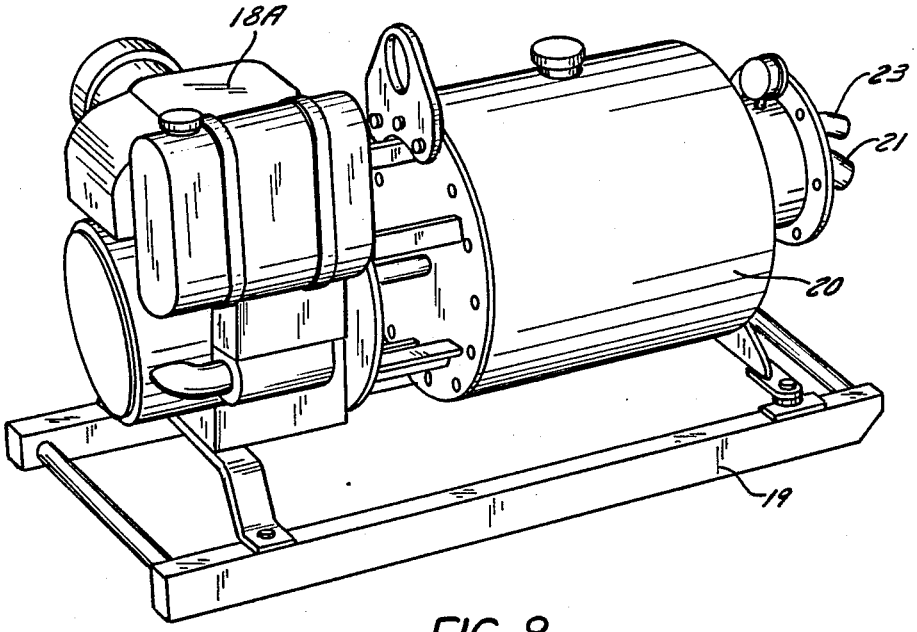
FIG. 8 is a perspective view, taken from the drive end, of the hydraulic pump and engine shown in FIG. 7.

In the preferred embodiment shown in FIGS. 1 and 2, hydraulic pump 20 is mounted on chassis 1 and driven by engine 18 of truck 10. However, as FIGS. 7 and 8 make clear, pump 20 can be driven by its own internal combustion engine 18A. For example, if the vehicle were a trailer (not shown) instead of a self-propelled truck, hydraulic pump 20 can be mounted on a support structure 19 on the trailer (not shown) and driven by its own internal combustion engine 18A, which is also mounted on the support structure 19 which is adapted for trailer mounting.

Figure 10:
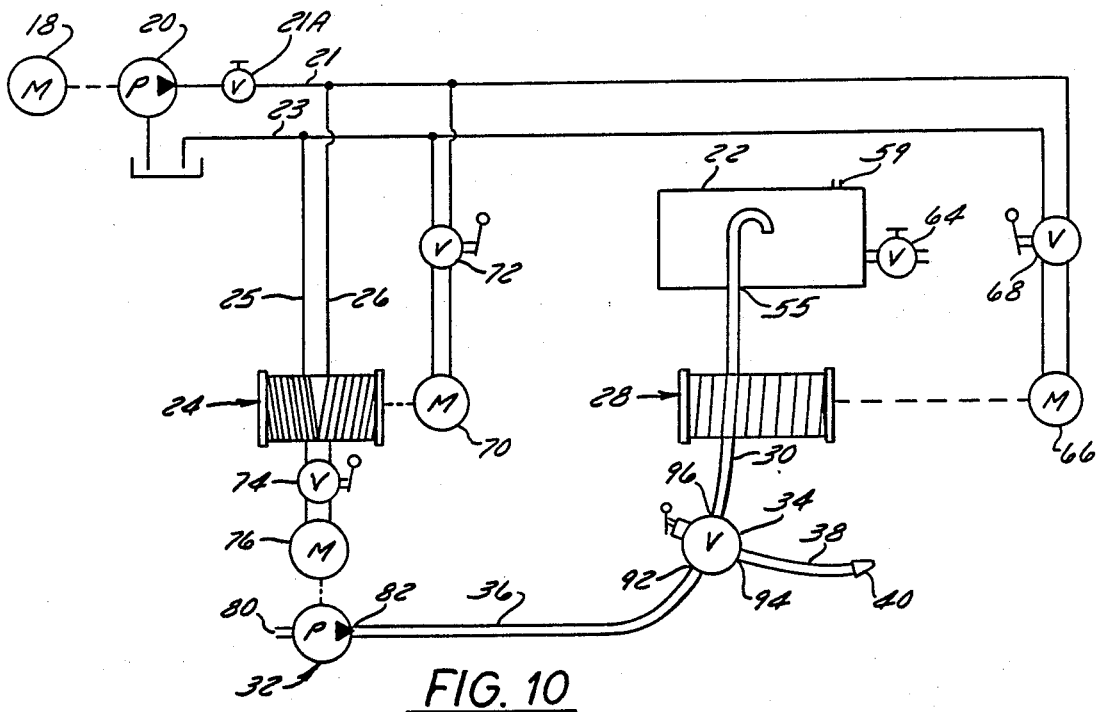
FIG. 10 is a schematic diagram of the hydraulic control circuit of the apparatus.

Referring to FIGS. 1, 2 and 10, a hose reel 24 is provided for the hydraulic fluid hoses 25 and 26 and is rotatably mounted on a side of truck chassis 12 and is driven in the pay-out and reel-in directions by a reversible hydraulic motor 70. Motor 70 is mounted on truck chassis 12 and is connected to main hydraulic fluid lines 21 and 23 of hydraulic pump 20 through a truck-mounted manually operable three position (off, forward, reverse) control valve 72.

The reel-mounted hydraulic fluid hoses 25 and 26, each of which is about one inch in diameter and 150 feet long, are connected at one end to the truck-mounted main fluid lines 21 and 23, respectively. A manually operable two position (off, on) control valve 74 is located in the hoses 25 and 26 between reel 24 and pump motor 76. Control valve 74 comprises two separate valves (not individually shown) in a common housing. Preferably, the main line 21 has a shut-off valve 21A therein which is normally open. The hydraulic fluid hoses 25 and 26 are connected at the other end to hydraulic pump motor 76 which is mounted on and operates to drive submersible pump 32.

Hose Means

Referring to FIGS. 1, 2 and 10, sewage hose 30 is a flexible plastic hose about two inches in diameter and about 150 feet in length which is mounted on a hose reel 28. One end of sewage hose 30 is permanently connected to tank inlet port 55 of holding tank 22. Hose reel 28 for sewage hose 30 is rotatably mounted on a side of truck chassis 12 and is driven in the pay-out and reel-in directions by a reversible hydraulic motor 66 which is mounted on chassis 12 and connected to the main fluid lines 21 and 23 of hydraulic pump 20 through a truck-mounted manually operable three position (off, forward, reverse) control valve 68.

The hose sections or extensions 36, 38 and 36A each take the form of a flexible plastic hose section about two inches in diameter and 20 feet in length. The ends of the hose sections 36, 38 and 36A, as well as the free end of sewage hose 30, are provided with detachable couplings, such as the cam-lock coupling shown in FIG. 19, to enable a hose end to be detachably connected to a system component (such as pump 32 or selector valve 34 or another hose section end) as particular system arrangements require. Hose section 38 is provided at one end with a detachable hose nozzle 40. The hose sections 36, 38 and 36A, when detached, are manually storable in holders 39 (FIG. 2) provided on truck 10 (as on the side of holding tank 22) which, for example, take the form of hollow tubes having end caps. The holders can also be used, while the hose sections are connected, to temporarily secure them to truck 10 during road transport.

The hose section 65 may take the form of a flexible hose about two inches in diameter and of sufficient length to connect tank outlet port 60 to pump inlet port 80, when portable pump 32 is mounted on truck 10, or could be some type of fixed piping arrangement (not shown) on truck 10.

Portable Selector Valve

Figure 19:
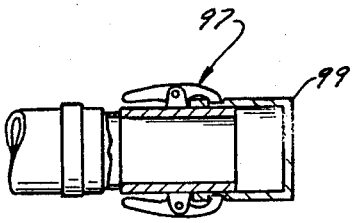
FIG. 19 is an enlarged side elevation view, partly in cross-section, showing an end cap closing off the end of a hose.
Figure 9:
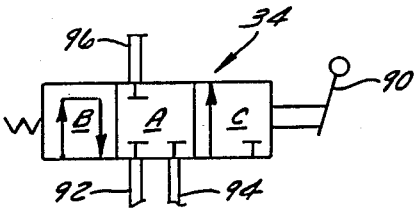
FIG. 9 is an enlarged schematic diagram of the selector valve shown in FIGS. 1, 2 and 10 through 14.

As FIG. 9 shows, optionally usable selector valve 34, which is detachably mounted on a support bracket 71A in chassis 12 of truck 10, is manually operable by a lever or handle 90 and has three valve ports, namely: a valve inlet port 92, a first valve outlet port 94 and a second valve outlet port 96. The valve ports 92, 94 and 96 are each adapted to receive and connect to quick-disconnect cam-lock couplers, such as coupler 97 shown in FIG. 19, provided on the hose end connectable thereto. Valve 34 has three basic positions, namely: a first or "off" position A (shown in FIG. 9) wherein all three valve ports are isolated from each other; a second position B (FIGS. 15 and 18) wherein valve inlet port 92 is connected to first valve outlet port 94; and a third position C (FIGS. 16 and 17) wherein valve inlet port 92 is connected to second valve outlet port 96. The extent to which the valve is open in both positions B and C is adjustable by the operator.

Portable Pump

Figure 4:
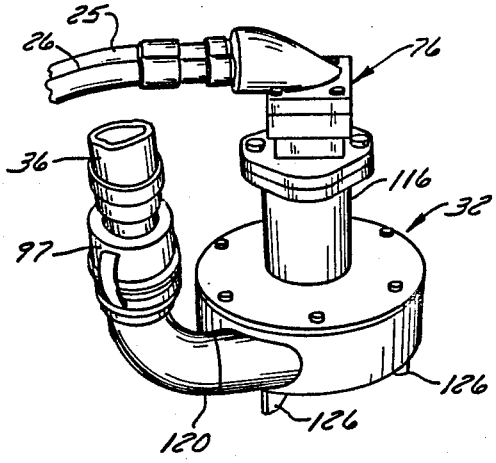
FIG. 4 is an enlarged perspective view, taken from above, of a submersible pump shown in FIG. 1.
Figure 5:
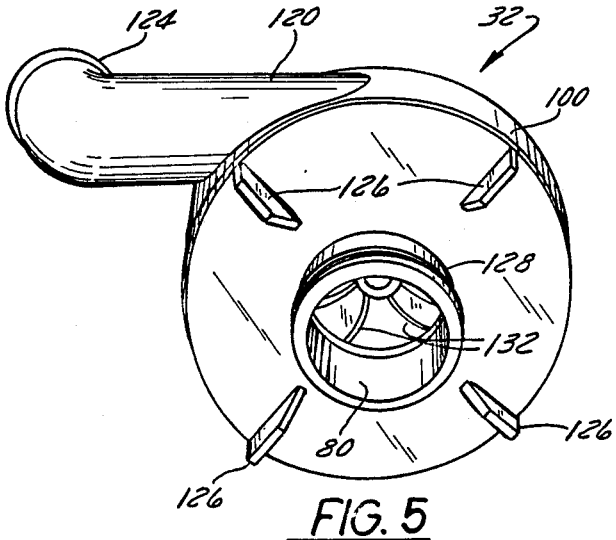
FIG. 5 is an enlarged perspective view, taken from below, of the submersible pump shown in FIG. 4.
Figure 6:
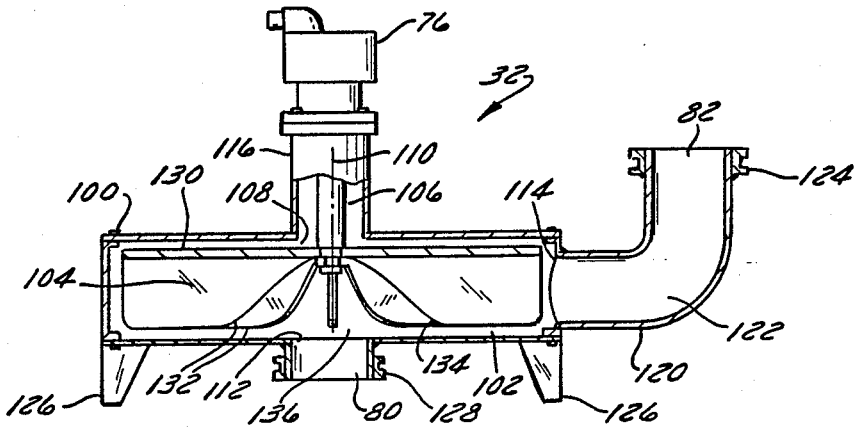
FIG. 6 is an enlarged cross-section view of the submersible pump shown in FIGS. 4 and 5.

Referring to FIGS. 4, 5 and 6, submersible pump 32 and pump motor 76 thereon form a compact, lightweight, powerful unit which can fit through the access openings in most types of septic tanks in common use, but is heavy enough to break through the crust 52 formed in the septic tank and be manually lowered by a rope (not shown) into the liquid 51 therebeneath. Pump 32 comprises a hollow housing 100 on which pump motor 76 is exteriorly mounted and defines an interior pump chamber 102 in which a pump impeller blade 104 is rotatably mounted. Housing 100 is preferably made of aluminum to reduce weight and facilitate handling by the operator and impeller blade 104 is preferably made of stainless steel to resist wear and corrosion. Impeller blade 104 is fixedly mounted on and rotatable with a pump motor shaft 106 of pump motor 76 which extends into pump chamber 102 through an upper shaft opening 108 along an axis of rotation 110. Hydraulic pump motor 76 is a commercially available component. Pump housing 100 has a pump inlet port 112 on its bottom side and a pump outlet port 114 on its lateral side, each of which ports communicate with pump chamber 102 about two inches in diameter so that the pump can pump liquid-suspended solids of up to 1½" in diameter. Pump housing 100 is generally cylindrical in form and twelve inches in diameter and about three inches high and pump chamber 102 is similarly configured and sized. Pump housing 100 has a hollow tubular extension 116 centrally located on its top side which supports pump motor 76 and through which motor shaft 106 extends. Pump housing 100 also has a hollow, tubular, L-shaped, upwardly-extending extension 120 on its lateral side with a passage 122 therethrough which communicates with pump outlet port 114. Extension 120 is provided on its outer end with a coupler 124 which is adapted for releasable connection to a cam-lock type coupler (see FIGS. 18 and 19) on the end of hose section 36. Pump housing 100 is provided on its bottom side with a plurality of stand-off legs 126 of such a length as to ensure that pump inlet port remains open and clear, even if pump 32 rests on the bottom of septic tank 42. Pump housing 100 is also provided on its bottom side with a coupler 128 which is disposed around pump inlet port 80 to enable a coupler on an end of conduit or hose 65 (see FIGS. 17 and 18) or hose 36A (see FIGS. 11 and 13) to be releasably connected to pump inlet port 80 during certain pumping operations. Pump inlet port 80 is circular and concentric with the axis of rotation 110. Pump impeller blade 104, visible in FIGS. 5 and 6, comprises an upper circular disc 130 from which a plurality of (four) integrally formed blades 132 extend downwardly. Each blade 132 is rounded as at 134 (FIG. 6) at the corner nearest inlet port 80 so as to define a generally conical space 136 adjacent pump inlet port 80. Furthermore, spacing between the corners 134 of each pair of the blades 132 is sufficient to accommodate any solid object able to enter pump inlet port 80 and space 136. While four blades 132 are shown, some other number of blades, such as two, three or more than four, could be employed, and they could vary in size, depending on pump size and pumping requirements.

Impeller blade 104 is rotatable by pump motor 76 at speeds of up to 4000 rpm and the design of submersible pump 32 is such that it can pump liquid at the rate of up to 200 gallons per minute at a pressure of up to 40 pounds per square inch. Pump 32 is designed to run wet or dry without damage and can ingest and expel solids up to 1½" in diameter without damage. The rate of pump delivery is determined by the speed of pump motor 76 which, in turn, is regulated or controlled by the setting of control valve 74.

Pump housing 100 and impeller blade 104 each can be fabricated as castings, but pump housing 100 must include a removable plate to afford access to the interior of the housing during manufacture and subsequent servicing.

Septic Tank

Figure 3:
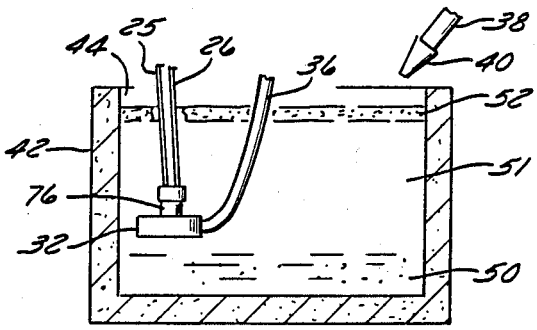
FIG. 3 is a cross-section view of the septic tank of FIG. 1 showing the typical initial disposition of waste materials contained therein.

FIGS. 1 and 3 depict septic tank 42 as a concrete box which is connected by an underground pipe 41 to a building 43 and by an underground pipe 45 to a drainage field (not shown) and typically has a, capacity of 1000 to 3000 gallons. Septic tank 42 has an opening 44 at its top through which it can be cleaned out. FIG. 3 show that tank 42 contains three layers of waste material designated 50, 51 and 52. The bottom layer is relatively heavy sludge 50 of mud-like consistency, which includes relatively heavy solid particulate organic waste material, dirt and sand, that has settled out at the bottom of septic tank 42. The middle layer is clarified, relatively clean, treated liquid or water 51 that accumulates in the digestive zone above sludge 50. The top layer is relatively light solid particulate waste material which has floated to the top of the liquid 51 and has dried to form a frangible crust 52 of earth-like consistency. However, in some cases septic tank 42 can contain primarily liquid 51 and little or no crust 52 or sludge 50, but it may be desirable to empty it of such liquid, with or without prior mixing.

Operation

The methods for operating the aforedescribed apparatus will now be described.

Referring to FIGS. 1, 2 and 11 through 18, initially assume that truck 10 is at the jobsite, that septic tank 42 is uncovered and contains waste material, that the hydraulic fluid lines 25 and 26 have been paid out from reel 24 and are connected to submersible pump motor 76, that engine 18 and main hydraulic pump 20 are in operation, that shut-off valve 21 is open, and that control valve 74 is closed. Also assume that sewage hose 30 has been paid out from reel 28 and is connected at one end to tank inlet port 55 of holding tank 22 and that tank shut-off valve 64 of holding tank 22 is closed. With these assumptions, as well as certain other assumptions hereinafter set forth as necessary, the following eight arrangements depicted in FIGS. 11 through 18 can be carried out.

Figure 11:
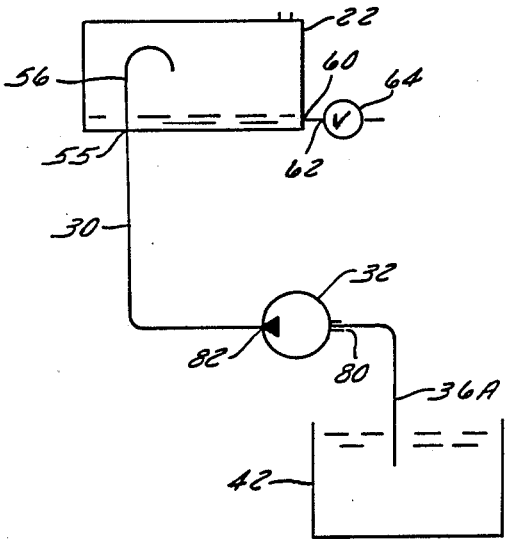
FIG. 11 is a schematic diagram showing the pump connected to pump waste material from the septic tank into the holding tank, with the pump disposed alongside the septic tank.

FIG. 11 shows a first arrangement wherein pump 32 is connected to pump waste material from septic tank 42 into holding tank 22, with pump 32 disposed alongside septic tank 42.

Figure 12:
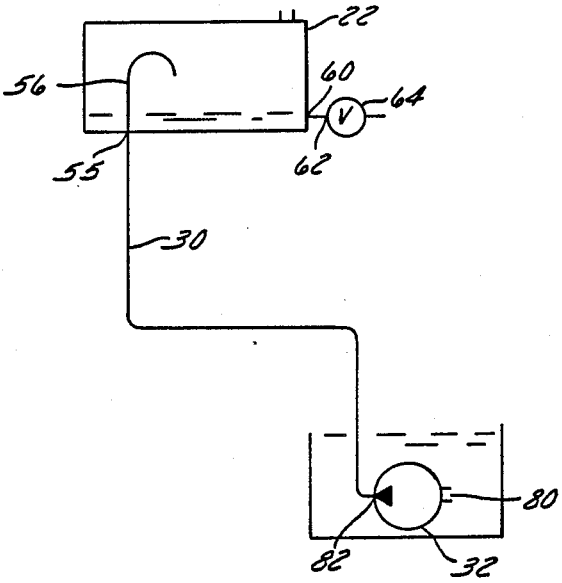
FIG. 12 is a schematic diagram showing the pump connected to pump waste material from the septic tank into the holding tank, with the pump submerged in the septic tank.

FIG. 12 shows a second arrangement wherein pump 32 is connected to pump waste material from septic tank 42 into holding tank 22, with pump 32 submerged in septic tank 42.

Figure 13:
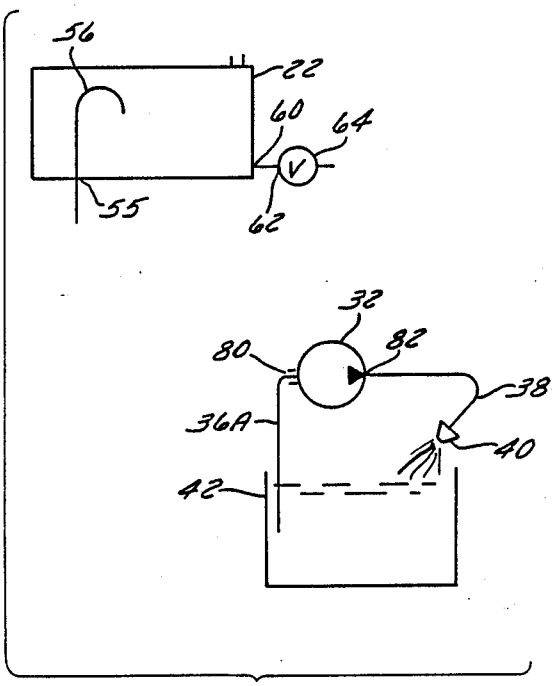
FIG. 13 is a schematic diagram showing the pump disconnected from the holding tank, disposed alongside the septic tank and connected to mix and recirculate waste material in the septic tank.

FIG. 13 shows a third arrangement wherein pump 32 is disconnected from holding tank 22, disposed alongside septic tank 42 and connected to mix and recirculate waste material in the septic tank.

Figure 14:
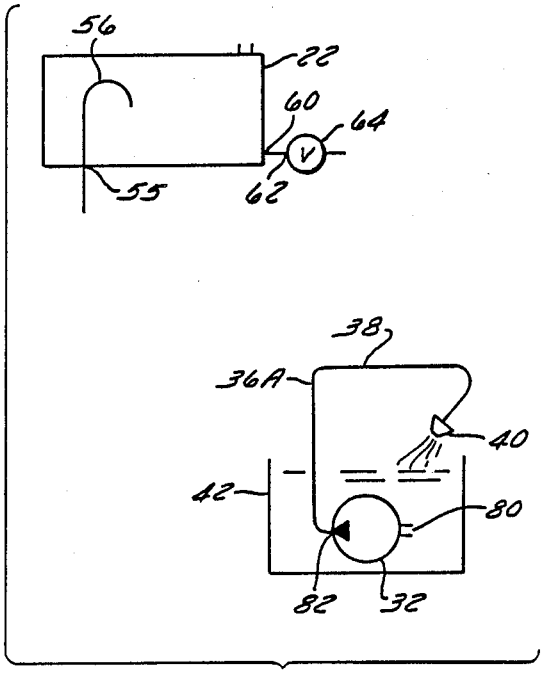
FIG. 14 is a schematic diagram showing the pump disconnected from the holding tank, submerged in the septic tank, and connected to mix and recirculate waste material in the septic tank.

FIG. 14 shows a fourth arrangement wherein pump 32 is disconnected from holding tank 22, submerged in septic tank 42, and connected to mix and recirculate waste material in the septic tank.

Figure 15:
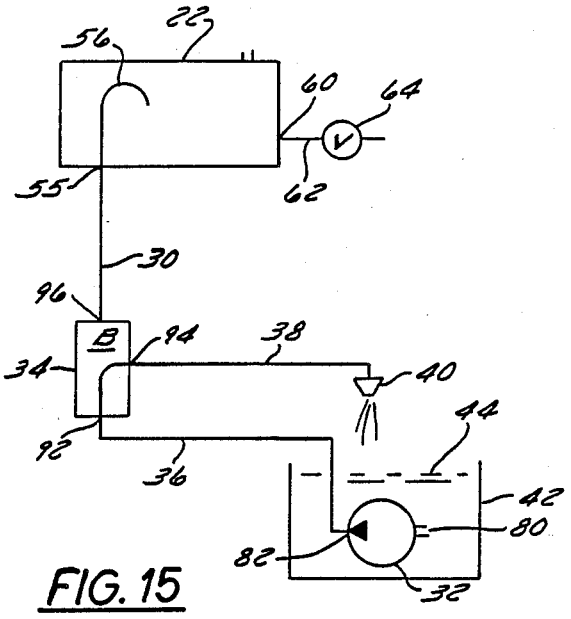
FIG. 15 is a schematic diagram showing the apparatus connected to mix and recirculate waste material in the septic tank.

FIG. 15 shows a fifth arrangement wherein the apparatus, including pump 32 and selector valve 34, is connected to mix and recirculate waste material in septic tank 42.

Figure 16:
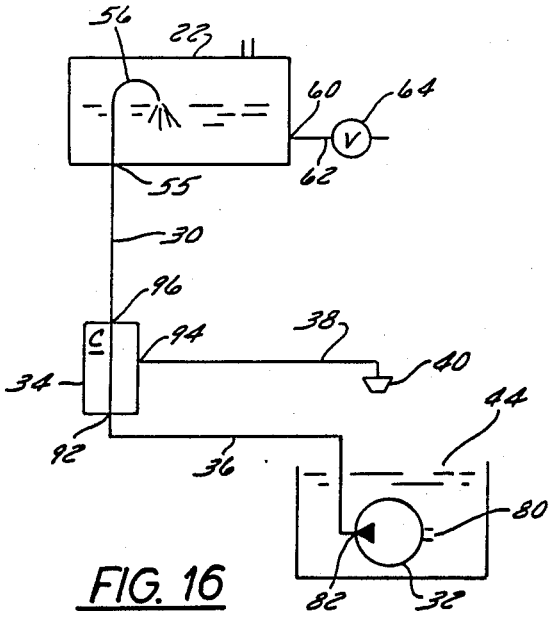
FIG. 16 is a schematic diagram showing the apparatus connected to pump waste material from the septic tank into a holding tank on the vehicle.

FIG. 16 shows a sixth arrangement wherein the apparatus, including pump 32 and selector valve 34, is connected to pump waste material from septic tank 42 into holding tank 22 on truck 10.

Figure 17:
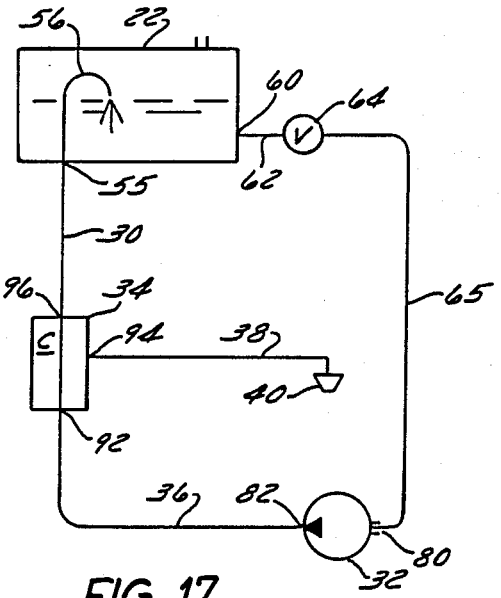
FIG. 17 is a schematic diagram showing the apparatus connected to mix and recirculate waste material in the holding tank.

Fig. 17 shows a seventh arrangement wherein the apparatus, including pump 32, selector valve 34 and hose section 65, is connected to mix and recirculate waste material in holding tank 22.

Figure 18:
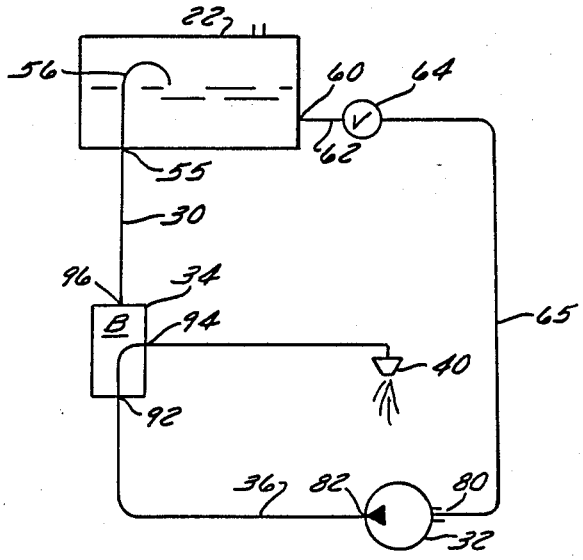
FIG. 18 is a schematic diagram showing the apparatus connected to discharge waste material from the holding tank into a disposal site.

FIG. 18 shows an eighth arrangement wherein the apparatus, including pump 32, selector valve 34 and hose section 65, is connected to discharge waste material from holding tank 22 into a disposal site.

Referring to FIG. 11, for example, if septic tank 42 is relatively shallow and contains fluid comprising liquid and little or no sludge or crust, then portable pump 32 can simply be placed on the ground alongside (near but not in) septic tank 42, sewage hose 30 can be connected to pump outlet port 82 and first extension hose 36A can be connected to pump inlet port 80 and inserted into the septic tank. Operation of pump 32 then causes fluid flow from septic tank 42, through first extension hose 36A, through portable pump 32, and through reel-mounted waste hose 30 into vehicle-mounted holding tank 22.

However, referring to FIG. 12, if septic tank 42 is relatively deep and contains fluid which is primarily liquid, it may be advantageous from the standpoint of pump efficiency not to employ first extension hose 36A but to suspend portable submersible pump 32 itself in septic tank 42 near the bottom of the fluid therein. Operation of pump 32 then causes fluid flow from septic tank 42, through portable pump 32, and through reel-mounted waste hose 30 into vehicle-mounted holding tank 22.

Also, if septic tank 42 contains fluid comprising sludge 50 and/or crust 52, as well as liquid 51, such as shown in FIG. 3, which needs to be mixed and fluidized before being pumped out, several approaches are possible. Referring to FIG. 13, with pump 32 near or alongside septic tank 42 and with first extension hose 36A lowered into the liquid in the septic tank, reel-mounted waste hose 30 leading to truck-mounted holding tank 42 may be disconnected from pump 32 and replaced by manually directable second extension hose 38 (preferably with nozzle 40 thereon) connected to pump outlet port 82. Operation of pump 32 then causes fluid flow from septic tank 42, through first extension hose 36A, through portable pump 32, and through second extension hose 38 which is aimed by the operator so that the high-pressure fluid stream therefrom is directed back into septic tank 42. The stream operates to break-up crust 52, to effect mixing and fluidizing of the septic tank contents and to effect recirculation of the fluid until the effluent is ready to be pumped into truck-mounted holding tank 22. This is accomplished by reconnecting reel-mounted waste hose 30 directly to pump outlet port 82 or to the manually directable second extension hose 38, after nozzle 40 is removed.

Referring to FIG. 14, if preferred, first extension hose 36A may be dispensed with and pump 32 may be lowered directly into the fluid in septic tank 42 and operated as above-described to effect mixing.

Referring to FIGS. 1, 10, 15 and 16, to avoid the trouble of having to connect and disconnect various hose sections and waste hose 30 above-described, especially when mixing and subsequent pump-out of septic tank 42 is involved, it is advantageous and convenient to employ multi-position selector valve 34. Selector valve 34 is connected between reel-mounted waste hose 30 and third extension hose 36 that is connected to pump outlet port 82. The manually directable second extension hose 38 is then connected to selector valve 34 so that the operator can use it to direct a high pressure stream of recirculated fluid back into septic tank 42 to effect mixing. Thus, referring to FIG. 15, assuming that portable pump 32 is either submerged in the fluid in septic tank 42 (as in FIG. 15) or connected thereto by the aforesaid first extension hose 36A (see FIG. 11), with selector valve 34 in one position and pump 32 in operation, fluid flows from septic tank 42 (through first extension hose 36A, if used), through portable pump 32, through selector valve 34 and through manually directable second extension hose 38 and nozzle 40 to effect recirculation and mixing. Referring to FIG. 16, with selector valve 34 in its other position and pump 32 in operation, fluid flows from septic tank 42 (through first extension hose 36A, if used), through portable pump 32, through selector valve 34 and through waste hose 30 into truck-mounted holding tank 22.

More specifically, as FIGS. 15 and 16 show, hose section 36 is connected between discharge port 82 of submersible pump 32 and valve inlet port 92 of selector valve 34. Hose section 38 is connected to valve outlet port 94 of selector valve 34. Selector valve 34 is in its off (A) position and submersible pump 32 is disposed in the liquid 51 in septic tank 42. The weight of submersible pump 32 enables it to be forced through frangible crust 52.

Referring to FIGS. 10 and 15, to effect mixing of the material in septic tank 42, selector valve 34 is manually moved to its B position and control valve 74 is manually moved to open position to start submersible pump 32. The liquid 51 in septic tank 42 enters pump inlet port 80 and is then pumped at high pressure through pump 32, through hose section 36, through selector valve 34 and through hose section 38. The operator, who is holding the nozzle end of hose section 38, directs nozzle 40 so that the high pressure stream of liquid enters septic tank 42 through opening 44, hits crust 52 in septic tank 42, breaks the crust into chunks or fragments and mixes the fragments with the liquid 51 in septic tank 42. As the crust breaks up and mixes, the high pressure stream of liquid is able to agitate the liquid 51, stir up the sludge 50 at the bottom of the septic tank, and gradually mix the sludge and crust material with the liquid 51 in the septic tank. The high pressure stream from nozzle 40 is directed to various regions in the septic tank so that the contents are mixed, emulsified, homogenized and fluidized to form a liquid mixture which is constantly recirculated by submersible pump 32 and forms the high pressure stream. Recirculation itself aids in the mixing. Thus, crust break-up and mixing are accomplished without the use of hand tools and no water is added to septic tank 42 from an outside source.

Referring now to FIG. 16, when the septic tank contents are thoroughly mixed (usually in five to ten minutes), the fluidized mixture of effluent is ready to be pumped into holding tank 22 on truck 10. This is accomplished by manually moving selector valve 34 into position C as shown in FIG. 16 so that the fluidized mixture in septic tank 42 enters pump inlet port 80 and is pumped at high pressure through pump 32, through hose section 36, through selector valve 34, through waste hose 30, through shut-off valve 57, and through tank inlet port 55 and conduit 56 into holding tank 22 on truck 10. This process takes a few minutes in a typical situation.

When septic tank 42 is empty, control valve 74 is manually closed to shut-off submersible pump 32. Then, submersible pump 32 is pulled out of septic tank 42. At this point, the exterior of pump 32 may be washed off by means of a garden hose connected to a nearby faucet. However, it is unnecessary to disconnect and clean the interior of the hose sections 36 and 38 and sewage hose 30. Instead, these hoses remain connected during transport to the disposal site. When the hoses are finally disassembled and stored, the ends are provided with a cap, such as cap 99 in FIG. 19, which is secured by a cam lock 97 to prevent evaporation and caking of liquid effluent left in the hoses and thereby maintains them in readiness for the next septic tank cleaning operation. Finally, the control valves 72 and 68 are manually turned to "reel-in" position so as to energize the hydraulic reel motors 70 and 66, respectively, for the reels 24 and 28, respectively, and reel in the hydraulic fluid lines 25, 26 and the sewage hose 30, respectively, whereupon the valves 72 and 68 are returned to off position. When sewage hose 30 is reeled in to a position wherein selector valve 34 is near the reel 28, selector valve 34 and the hose sections 36 and 38 still connected thereto, are manually placed on holders 71 (FIG. 2) provided on truck chassis 12, where they are securely attached for road transport.

Referring to Fig. 17, while truck 10 is in transit from the jobsite to a disposal site, it is sometimes desirable to agitate and mix the liquid effluent in holding tank 22 to prevent sludge build-up in tank 22 before it can be emptied. As FIG. 17 shows, this is accomplished by providing short hose or conduit 65 which is connected between pump inlet port 80 of submersible pump 32 (now stationarily mounted on chassis 12 of truck 10) and tank outlet port 60 of holding tank 22. After hose 65 is connected, shut-off valve 64 for holding tank outlet port 60 is opened, selector valve 34 (also now stationarily mounted on truck chassis 12) is moved to its position C. Thus, when control valve 74 is moved to open position to start submersible pump 32, fluidized effluent flows from holding tank 22, through tank outlet port 60, through shut-off valve 64, through hose 65, through submersible pump 32, through selector valve 34, through sewage hose 30, and through tank inlet port 55 and pipe 56 back into holding tank 22. The effluent in tank 22 is thereby constantly recirculated and maintained in fluidized condition, ready for discharge at the disposal site. Such recirculation prevents build-up of sludge and solids in holding tank 22.

Referring to Fig. 18, when truck 10 reaches the disposal site, the effluent is ready to be discharged from holding tank 22. This is readily accomplished by detaching hose section 38 from its holder 39 on chassis 12 and aiming or placing its nozzle 40 into an appropriate facility (not shown) at the holding site and manually moving selector valve 34 from position C (FIG. 17) to position B (FIG. 18). Assuming that portable submersible pump 32 is still in operation, fluidized effluent flows from holding tank 22, through tank outlet port 60, through shut-off valve 64 (still open), through hose 65, through submersible pump 32, through selector valve 34, and through hose section 38 into the disposal site. When holding tank 22 is empty, submersible pump 32 is stopped. At this point, hose 65 is disconnected (at least from submersible pump inlet port 80) and the apparatus is substantially ready to move to another jobsite. If preferred, all components may be disconnected and stored as shown in FIG. 2.

I claim:

1. Apparatus for emptying a first tank (42) comprising:

a holding tank (22) having a tank inlet port (55) and movable to a jobsite whereat a first tank (42) is located, said first tank (42) containing liquid and solids in said liquid and having an access opening (44) therein;

a portable pump (32) operable to ingest liquid and solids in said liquid through a pump inlet port (80) and to expel the ingested liquid and solids in said liquid in a pressurized stream through a pump outlet port (82), said portable pump (32) being adapted to be located remote from said holding tank (22) and near said first tank (42) and having said pump inlet port (80) in communication with said liquid in said first tank (42);

a hose (30) for connecting said pump outlet port (82) to said tank inlet port (55);

and power supply means for operating said portable pump (32) while it is disposed near said first tank (42) to effect pumping of the contents of said first tank (42) into said holding tank.

2. Apparatus according to claim 1 wherein said portable pump (32) is located outside of the liquid in said first tank (42) and including hose means (36) extending through said access opening (44) in said first tank (42) and connected between said pump inlet port (80) and the liquid in said first tank (42).

3. Apparatus according to claim 1 wherein said portable pump (32) is submerged in the liquid in said first tank (42) through said access opening (44) in said first tank (42 and said pump inlet port (80) is in communication with said liquid in said first tank (42).

4. Apparatus according to claim 1 or 2 or 3 wherein said power supply means comprises a power source which is located remotely from said portable pump (32).

5. Apparatus according to claim 4 including a vehicle (10) and wherein said holding tank (22) and said power source are mounted on said vehicle.

6. Apparatus according to claim 5 wherein said hose (30) is windable on a hose reel (28) on said vehicle (10).

7. Apparatus according to claim 6 wherein said power supply means further comprises a flexible member (25, 26) connected between said power supply source and said portable pump (32).

8. Apparatus according to claim 7 wherein said flexible member (25, 26) is windable on a reel (24) on said vehicle (10).

9. Apparatus for mixing liquid and solids contained in a first tank (42) which has an access opening (44) therein comprising:

a portable pump (32) operable to ingest liquid and solids in said liquid through a pump inlet port (80) and to expel the ingested liquid and solids in said liquid in a pressurized stream through a pump outlet port (82), said portable pump (32) being adapted to be located on or within said first tank (42) and having said pump inlet port (80) in communication with said liquid in said first tank (42);

power supply means for operating said portable pump (32);

and means for directing said stream from said pump outlet port (82) into said first tank (42) through said access opening (44) therein to effect mixing of the liquid and solids in said first tank (42).

10. Apparatus according to claim 9 wherein said portable pump (32) is located outside of the liquid in said first tank (42) and including hose means (36) extending through said access opening (44) in said first tank (42) and connected between said pump inlet port (80) and the liquid in said first tank (42).

11. Apparatus according to claim 9 wherein said portable pump (32) is submerged in the liquid in said first tank (42) through said access opening (44) in said first tank (42) and said pump inlet port (80) is in communication with said liquid in said first tank (42).

12. Apparatus according to claim 9 or 10 or 11 wherein said power supply means comprises a power source which is located remotely from said portable pump (32).

13. Apparatus according to claim 12 including a vehicle (10) and wherein said power source is located on said vehicle.

14. Apparatus according to claim 13 wherein said power supply means further comprises a flexible member (25, 26) connected between said power supply source and said portable pump (32).

15. Apparatus according to claim 14 wherein said flexible member (25, 26) is windable on a reel (24) on said vehicle (10).

16. Apparatus for mixing liquid and solids contained in a first tank (42) and for subsequently emptying said first tank (42) comprising:

a holding tank (22) having a tank inlet port (55) and movable to a jobsite whereat said first tank (42) is located, said first tank (42) containing liquid and solids in said liquid and having an access opening (44) therein;

a portable pump (32) operable to ingest liquid and solids in said liquid through a pump inlet port (80) and to expel the ingested liquid and solids in said liquid in a pressurized stream through a pump outlet port (82), said portable pump (32) being adapted to be located remote from said holding tank (22) and near said first tank (42) and having said pump inlet port (80) in communication with said liquid in said first tank (42);

power supply means for operating said portable pump (32) while it is disposed near said first tank (42);

and means for directing said pressurized stream from said pump outlet port (82) through said access opening (44) into said first tank (42) to effect mixing of the liquid and solids in said first tank (42) and for subsequently directing said pressurized stream from said pump outlet port (82) through said tank inlet port (55) into said holding tank (22).

17. Apparatus according to claim 16 wherein said portable pump (32) is located outside of the liquid in said first tank (42) and including hose means (36) extending through said access opening (44) in said first tank (42) and connected between said pump inlet port (80) and the liquid in said first tank (42).

18. Apparatus according to claim 16 wherein said portable pump (32) is submerged in the liquid in said first tank (42) through said access opening (44) in said first tank (42) and said pump inlet port (80) is in communication with said liquid in said first tank (42).

19. Apparatus according to claim 16 or 17 or 18 wherein said power supply means comprises a power source which is located remotely from said portable pump (32).

20. Apparatus according to claim 19 including a vehicle (10) and wherein said holding tank (22) and said power source are mounted on said vehicle.

21. Apparatus according to claim 20 wherein said means for directing said stream comprises a first hose (38) directable toward said opening (44) in said first tank (42), a second hose (30) connected to said tank inlet port (55) of said holding tank (22), and means for selectively connecting either said first hose (38) or said second hose (30) to said pump outlet port (82) of said portable pump (32).

22. Apparatus according to claim 21 wherein said means for selectively connecting said first and second hoses (38, 30) comprises a selector valve (34).

23. Apparatus for mixing and pumping liquid comprising:

a portable submersible pump (32) operable to ingest liquid through a pump inlet port (80) and to expel liquid through a pump outlet port (82);

and connecting means for connecting said submersible pump (32) relative to a first tank (42) and a second tank (22) to enable a stream of liquid delivered by said submersible pump (32) to be directed so that when said submersible pump (32) is disposed and operated in liquid in said first tank (42), the stream of liquid comprises liquid pumped from said first tank (42) and is returned to said first tank (42) to effect mixing of liquid in said first tank (42) and is subsequently directed to said second tank (22).

24. Apparatus according to claim 23 wherein said connecting means comprises:

a multi-position selector valve (34);

a first conduit (36) connected between said pump outlet port (82) and said selector valve (34);

a second conduit (30) connected between said selector valve (34) and said second tank (22);

and a third conduit (38) having one end connected to said selector valve (34) and a free end (40) for directing the stream of liquid back into said first tank (42).

25. Apparatus according to claim 23 wherein said connecting means further enables a stream of liquid to be directed so that, when said submersible pump (32) is removed from said first tank (42) and operated, the stream of liquid comprises liquid pumped from said second tank (22) which is returned to said second tank (22) to effect mixing of liquid in said second tank (22).

26. Apparatus according to claim 23 or 25 wherein said connecting means further enables a stream of liquid to be directed so that, when said submersible pump (32) is removed from said first tank (42) and operated, the stream of liquid comprises liquid pumped from said second tank (22) which is directed into a disposal site.

27. Apparatus according to claim 26 wherein said connecting means comprises:

a multi-position selector valve;

a first conduit (30) connected between said pump outlet port (82) and said selector valve (34);

a second conduit (30) connected between said selector valve (34) and said second tank (22);

a third conduit (38) having one end connected to said selector valve (34) and having a free end (40) for directing a stream of liquid back into said first tank (42) or into a disposal site;

and a fourth conduit (65) connected between said second tank (22) and said inlet port (80) of said submersible pump (32).

28. Apparatus for mixing liquid in a first tank (42) and for pumping the mixed liquid into a second tank (22), said apparatus comprising:

a portable submersible pump (32) having a pump motor 776) thereon and adapted for submersion in liquid in said first tank (42), said submersible pump comprising a pump inlet port (80) and a pump outlet port (82);

means (18, 20, 25, 26) for driving said pump motor (72) so that said submersible pump (32) ingests liquid through said pump inlet port (80) and expels liquid at high pressure through said pump outlet port (82);

said submersible pump (32), when submerged in liquid in said first tank (42), being operable to ingest liquid in said first tank (42) through said pump inlet port (80) and to expel the ingested liquid at high pressure through said pump outlet port (82);

and directing means (36, 34, 38, 30) for directing a stream of liquid ingested from said first tank (42) and expelled through said pump outlet port (82) at high pressure back into said first tank (42) to effect mixing and recirculation of liquid in said first tank (42) and for subsequently directing said stream of liquid into said second tank (22).

29. Apparatus according to claim 28 wherein said directing means further includes conduit means (65) to connect said pump inlet port (80) to liquid in said second tank (22) whereby, when said submersible pump (32), when removed from said first tank (42) and connected to said second tank (22) by said conduit means (65), is operable to ingest liquid in said second tank (22) through said pump inlet port (80) and to expel that ingested liquid at high pressure through said pump outlet port (82);

and whereby a stream of liquid ingested from said second tank (22) and expelled through said pump outlet port (82) at high pressure is directed back into said second tank (22) to effect mixing and recirculation of liquid in said second tank (22).

30. Apparatus according to claim 29 wherein said directing means is further operable, after recirculation of liquid in said second tank (22) is completed, for directing a stream of liquid ingested from said second tank (22) and expelled through said pump outlet port (82) and said directing means into a disposal site.

31. Apparatus according to claim 28 wherein said directing means for directing said stream of liquid comprises:

a selector valve (34) operable to a plurality of positions;

a first conduit (30) connected between said second tank (22) and said selector valve (34);

a second conduit (36) connected between said pump outlet port (82) of said submersible pump (32) and said selector valve (34);

and a third conduit (38) having one end connected to said selector valve (34) and having a free end through which said stream of liquid is expelled;

said selector valve (34) having one position (B) wherein said second conduit (36) is connected to said one end of said third conduit (38) to enable said submersible pump (32) to effect recirculation of liquid in said first tank (42);

said selector valve (34) having another position (C) wherein said second conduit (36) is connected to said first conduit (30) to enable said submersible pump (32) to effect pumping of mixed liquid from said first tank (42) into said second tank (22).

32. Apparatus for mixing liquid in a first tank (42), for pumping the mixed liquid from said first tank (42) into a second tank (22), for mixing the liquid in said second tank (22), and for discharging the mixed liquid in said second tank (22) into a disposal site, said apparatus comprising:

a second tank (22) having a tank inlet port (55) and a tank outlet port (60);

a portable submersible pump (32) having a pump motor (76) thereon and adapted for submersion in liquid in said first tank (42), said submersible pump (32) having a pump inlet port (80) and a pump outlet port (82);

means (18, 20, 25, 26) for driving said pump motor (76) so that said submersible pump (32) ingests liquid through said pump inlet port (80) and expels liquid at high pressure through said pump outlet port (82);

a selector valve (34) operable to a plurality of positions (B, C);

a first conduit((30) connected between said tank inlet port (55) of said second tank (22) and said selector valve (34);

a second conduit (36) connected between said pump outlet port (82) of said submersible pump (32) and said selector valve (34);

a third conduit (38) having one end connected to said selector valve (34) and having a free end (40) through which a stream of liquid can be expelled;

and a fourth conduit (65) having one end connectable to said tank outlet port (60) of said second tank (22) and having its other end connectable to said pump inlet port (80) of said submersible pump (32);

said selector valve (34) having one position (B) wherein said second conduit (36) is connected to said one end of said third conduit (38);

said selector valve (34) having another position (C) wherein said second conduit (36) is connected to said first conduit (30);

said apparatus being operable alternately:

to enable said submersible pump (32), when submerged in liquid in said first tank (42) and when said selector valve (34) is in its said one position (B), to effect recirculation and mixing of liquid in said first tank (42);

to enable said submersible pump (32), when submerged in liquid in said first tank (42) and when said selector valve (34) is in its said another position (C), to effect pumping of mixed liquid from said first tank (42) into said second tank (22);

to enable said submersible pump (32), when removed from said first tank (42), when said fourth conduit (65) is connected between said tank outlet port (60) and said pump inlet port (80), and when said selector valve (34) is in its said another position (C), to effect recirculation and mixing of liquid in said second tank (22);

and to enable said submersible pump (32), when removed from said first tank (42), when said fourth conduit (65) is connected between said tank outlet port (60) and said pump inlet port (80), and when said selector valve (34) is in its said one position (B), to effect pumping o said mixed liquid from said second tank (22) into said disposal site.

33. Apparatus for mixing, removing, transporting and disposing of fluid waste material from a septic tank (42) or the like comprising:

a vehicle (10);

a holding tank (22) on said vehicle (10) and having a tank inlet port (55) and a tank outlet port (60);

a portable submersible pump (32) having a pump motor (76) thereon and adapted to be detachably mounted on said vehicle (10) and disposed in fluid waste material in said septic tank (42), said submersible pump (32) having a pump inlet port (80) and a pump outlet port (82);

power supply means (18, 20, 25, 26) on said vehicle for operating said pump motor (76) of said submersible pump (32);

a portable selector valve (34) adapted to be detachably mounted on said vehicle (10);

a first hose (30) carried on said vehicle (10) and connected between said tank inlet port (55) and said selector valve (34);

a second hose (36) adapted to be carried on said vehicle (10) and connected between said selector valve (34) and said pump outlet port (82) of said submersible pump (32);

and a third hose (38) adapted to be carried on said vehicle (10) and having one end connected to said selector valve (34) and having a free end (40);

said selector valve (34) having one position (B) wherein, when said submersible pump (32) is disposed and operating in fluid waste material in said septic tank (42), said fluid is directed through said submersible pump (32), through said second hose (36), through said selector valve (34), and through said third hose (38) back into said septic tank (42) to effect mixing of fluid waste material in said septic tank (42);

said selector valve (34) having another position (C) wherein, when said submersible pump (32) is disposed and operating in fluid waste material in said septic tank (42), said fluid is directed through said submersible pump (32), through said second hose (36), through said selector valve (34), and through said first hose (30) into said holding tank (22).

34. Apparatus according to claim 33 further including a first hose reel (28) on said vehicle (10) on which said first hose (30) can be wound.

35. Apparatus according to claim 33 or 34 wherein said pump motor (76) of said submersible pump (32) is a hydraulic motor, wherein said power supply means on said vehicle comprises a motor-driven hydraulic pump (20) and hydraulic fluid hoses (25, 26) connected between said motor-driven hydraulic pump (20) and said hydraulic motor (76) of said submersible pump (32).

36. Apparatus according to claim 35 further including a second hose reel (24) on said vehicle (10) on which said hydraulic fluid hoses (25, 26) can be wound.

37. Apparatus according to claim 36 further including hydraulic motors (66, 70) for the first and second hose reels (28, 24) and wherein said motor-driven hydraulic pump (20) supplies hydraulic fluid for operating the hydraulic motors (66, 70) for the hose reels (28, 24).

38. Apparatus according to claim 37 wherein said power supply means on said vehicle (10) comprises an internal combustion engine (18) for driving said motor-driven hydraulic pump.

39. Apparatus according to claim 38 wherein said vehicle (10) is a truck and wherein said internal combustion engine (18) is also adapted to furnish motive power to said truck.

40. A method for removing fluid material comprising liquid and particulate solids from a first tank (42) having an access opening (44) therein comprising the steps of:

moving a holding tank (22) having a tank inlet port (55) to the vicinity of said first tank (42);

providing a portable pump (32) having a pump inlet port (80) and a pump outlet port (82) and having a pump motor (76) thereon to operated said portable pump (32), said portable pump (32) with said pump motor (76) thereon being adapted for disposition within said first tank (42);

disposing said portable pump (32) near said first tank (42) with said pump inlet port (80) communicating with said fluid material in said first tank (42) and said pump outlet port (82) communicating with said tank inlet port (55) of said holding tank (22);

and operating said portable pump (32) to provide a stream of fluid material which flows from said first tank (42) into said holding tank (22).

41. A method according to claim 40 wherein the step of disposing said portable pump (32) near said first tank (42) comprises the step of inserting a hose section (36A) connected to said portable pump inlet port (80) through said access opening (44) and into said fluid material in said first tank (42).

42. A method according to claim 40 wherein the step of disposing said portable pump (32) near said first tank (42) comprises the step of inserting said portable pump (32) through said access opening (44) and into said fluid material in said first tank (42).

43. method for mixing fluid material comprising liquid and particulate solids contained in a first tank (42) having an access opening (44) therein comprising the steps of:

providing a portable pump (32) having a pump inlet port (80) and a pump outlet port (82) and having a pump motor (76) thereon to operate said portable pump (32), said portable pump (32) with said pump motor (76) thereon being adapted for disposition within said first tank (42);

disposing said portable pump (32) near said first tank (42) with said pump inlet port (80) communicating with said fluid material in said first tank (42);

operating said portable pump (32) to provide a stream of fluid material which flows from said first tank (42);

and directing said stream of fluid material through said access opening (44) into said fluid material in said first tank (42) to effect mixing of said fluid material in said first tank (42).

44. A method according to claim 43 wherein the step of disposing said portable pump (32) near said first tank (42) comprises the step of inserting a hose section (36) connected to said portable pump inlet port (80) through said access opening (44) and into said fluid material in said first tank (42).

45. A method according to claim 43 wherein the step of disposing said portable pump (32) near said first tank (42) comprises the step of inserting said portable pump (32) through said access opening (44) and into said fluid material in said first tank (42).

46. A method for mixing fluid material comprising liquid and particulate solids contained in a first tank (42) having an access opening (44) therein and for subsequently transferring the mixed fluid material from said first tank (42) into a holding tank (22) having a tank inlet port (55), said method comprising the steps of:

moving said holding tank (22) to the vicinity of said first tank (42);

providing a portable pump (32) having a pump inlet port (80) and a pump outlet port (82) and having a pump motor (76) thereon to operate said portable pump (32), said portable pump (32) with said pump motor (76) thereon being adapted for disposition within said first tank (42);

disposing said portable pump (32) near said first tank (42) with said pump inlet port (80) communicating with said fluid material in said first tank (42);

operating said portable pump (32) to provide a stream of fluid material;

directing said stream of fluid material through said access opening (44) into said fluid material in said first tank (42) to effect mixing of said fluid material in said first tank (42); and subsequently directing said stream of fluid material through said tank inlet port (55) and into said holding tank (22).

47. A method according to claim 46 wherein the step of disposing said portable pump (32) near said first tank (42) comprises the step of inserting a hose section (36A) connected to said portable pump inlet port (80) through said access opening (44) and into said fluid material in said first tank (42).

48. A method according to claim 46 wherein the step of disposing said portable pump (32) near said first tank (42) comprises the step of inserting said portable pump (32) through said access opening (44) and into said fluid material in said first tank (42).

49. A method for mixing liquid in a first tank (42) and for pumping the mixed liquid ito a second tank (22) comprising the steps of:

providing a first tank (42) having liquid therein;

providing a second tank (22);

disposing a submersible pump (32) in liquid in said first tank (42) and operating said submersible pump (32) so as to ingest liquid in said first tank (42) and to provide a stream of liquid exteriorly of said first tank (42);

directing said stream of liquid back into said first tank (42) to effect mixing and recirculation of liquid in said first tank (42);

and subsequently directing said stream of liquid into said second tank (22).

50. A method for mixing liquid in a first tank (42), for pumping the mixed liquid into a second tank (22) and for pumping the liquid from the second tank (22), said method comprising the steps of:

providing a first tank (42) having liquid therein;

providing a second tank (22);

disposing a submersible pump (32) in liquid in said first tank (42) and operating said submersible pump (22) so as to ingest liquid in said first tank (42) and provide a stream of liquid exteriorly of said first tank (42);

directing said stream of liquid back into said first tank (42) to effect mixing and recirculation of liquid in said first tank (42):

subsequently directing said stream of liquid into said second tank (22);

removing said submersible pump (32) from said first tank (42);

supplying liquid from said second tank (22) to said submersible pump (32) and operating said submersible pump (32) so as to ingest liquid in said second tank (22) and provide a second stream of liquid;

and directing said second stream of liquid into a disposal site.

51. A method for mixing liquid in a first tank (42), for pumping the mixed liquid into a second tank (22) and for further mixing the liquid when it is in the second tank (22), said method comprising the steps of:

providing a first tank (42) having liquid therein;

providing a second tank (22);

disposing a submersible pump (32) in liquid in said first tank (42) and operating said submersible pump (32) so as to ingest liquid in said first tank (42) and provide a stream of liquid exteriorly of said first tank (42);

directing said stream of liquid back into said first tank (42) to effect mixing and recirculation of liquid in said first tank (42);

subsequently directing said stream of liquid into said second tank (22);

removing said submersible pump (32) from said first tank (42);

supplying liquid from said second tank (22) to said submersible pump (32) and operating said submersible pump (32) so as to ingest liquid in said second tank (22) and provide a second stream of liquid exteriorly of said second tank (22);

and directing said second stream of liquid back into said second tank (22) to effect mixing and recirculation of liquid in said second tank (22).

52. A method according to claim 51 including the further step of subsequently directing said second stream of liquid into a disposal site instead of back into said second tank (22).

53. A method emptying a septic tank (42) which has an opening (44) at the top and contains waste material in the form of a layer of sludge (50) at the bottom of the septic tank (42), a layer of liquid (51) above the sludge (50), and a layer of frangible crust (52) floating on the surface of the liquid (51), said method comprising the steps of:

disposing a submersible pump (32) having a pump inlet port (80) and a pump outlet port (82) in the layer of liquid (51) and operating said submersible pump (32) so as to ingest said liquid and provide a stream of liquid at high pressure exteriorly of said septic tank (42);

directing said stream back into said septic tank (42) through said opening (44) to effect break-up of said crust (52), to effect mixing of the broken crust and said sludge (50) with said liquid (51) in said septic tank (42) to form a fluidized mixture, and to effect recirculation of said fluidized mixture through said submersible pump (32) and back into said septic tank (42) as a high pressure stream of liquid;

and subsequently directing said fluidized mixture from said septic tank (42) and through said submersible pump (32) into a holding tank (22).

54. A method according to claim 53 including the further steps of:

removing said submersible pump (32) from said septic tank (42);

connecting said submersible pump (32) so as to ingest said fluidized mixture from said holding tank (22) and provide a second stream of liquid;

and directing said second stream of liquid into a disposal site so as to empty said holding tank (22).

55. A method according to claim 54 including the further step of directing said second stream of liquid back into said holding tank (22) prior to directing said second stream of liquid into said disposal site in order to effect mixing and maintain fluidity of the fluidized mixture in said holding tank (22).

56. Apparatus for mixing liquid and solids contained in a first tank (42) which has an access opening (44) therein comprising:

a portable pump (32) operable to ingest liquid and solids in said liquid through a pump inlet port (80) and to expel the ingested liquid and solids in said liquid in a pressurized stream through a pump outlet port (82), said portable pump (32) being adapted to be located near said first tank (42) and having said pump inlet port (80) in communication with said liquid in said first tank (42), said portable pump (32) being submerged in the liquid in said first tank (42) through said access opening (44 in said first tank (42) and said pump inlet port (80) being in communication with said liquid in said first tank (42);

power supply means for operating said portable pump (32);

and means for directing said stream from said pump outlet port (82) into said first tank (42) through said access opening (44) therein to effect mixing of the liquid and solids in said first tank (42).

57. Apparatus according to claim 56 wherein said power supply means comprises a power source which is located remotely from said portable pump (32).

58. Apparatus according to claim 56 or 57 including a vehicle (10) and wherein said power source is located on said vehicle.

59. Apparatus according to claim 58 wherein said power supply means further comprises a flexible member (25, 26) connected between said power supply source and said portable pump (32).

60. Apparatus according to claim 59 wherein said flexible member (25, 26) is windable on a reel (24) on said vehicle (10).

61. A method for removing fluid material comprising liquid and particulate solids from a first tank (42) having an access opening (44) therein comprising the steps of:

moving a holding tank (22) having a tank inlet port (55) to the vicinity of said first tank (42);

providing a portable pump (32) having a pump inlet port (80) and a pump outlet port (82) and having a pump motor (76) thereon to operate said portable pump (32);

disposing said portable pump (32) near said first tank (42) with said pump inlet port (80) communicating with said fluid material in said first tank (42) and said pump outlet port (82) communicating with said tank inlet port (55) of said holding tank (22), said step of disposing said portable pump (32) near said first tank (42) comprising the step of insetting said portable pump (32) through said access opening (44) and into said fluid material in said first tank (42);

and operating said portable pump (32) to provide a stream of fluid material which flows from said first tank (42) into said holding tank (22).

62. A method for mixing fluid material comprising liquid and particulate solids contained in a first tank (42) having an access opening (44) therein comprising the steps of:

providing a portable pump (32) having a pump inlet port (80) and a pump outlet port (82) and having a pump motor (76) thereon to operate said portable pump (32);

disposing said portable pump (32) near said first tank (42) with said pump inlet port (80) communicating with said fluid material in said first tank (42), said step of disposing said portable pump (32) near said first tank (42) comprising the step of inserting said portable pump (32) through said access opening (44) and into said fluid material in said first tank (42);

operating said portable pump (32) to provide a stream of fluid material which flows from said first tank (42);

and directing said stream of fluid material through said access opening (44) into said fluid material in said first tank (42) to effect mixing of said fluid material in said first tank (42).

63. A method for mixing fluid material comprising liquid and particulate solids contained in a first tank (42) having an access opening (44) therein and for subsequently transferring the mixed fluid material from said first tank (42) int a holding tank (22) having a tank inlet port (55), said method comprising the steps of:

moving said holding tank (22) to the vicinity of said first tank (42);

providing a portable pump (32) having a pump inlet port (80) and a pump outlet port (82) and having a pump motor (76) thereon to operate said portable pump (32);

disposing said portable pump (32) near said first tank (42) with said pump inlet port (80) communicating with said fluid material in said first tank (42), said step of disposing said portable pump (32) near said first tank (42) comprising the step of inserting said portable pump (32) through said access opening (44) and into said fluid material in said first tank (42);

operating said portable pump (32) to provide a stream of fluid material;

directing said stream of fluid material through said access opening (44) into said fluid material in said first tank (42) to effect mixing of said fluid material in said first tank (42);

and subsequently directing said stream of fluid material through said tank inlet port (55) and into said holding tank (22).

* * * * *